United States Patent [19]

Yamazaki et al.

[11] 4,095,135

[45] June 13, 1978

[54] SPHERICAL-BULB FLUORESCENT LAMP

[75] Inventors: Haruo Yamazaki, Moriyama; Hidezoh Akutsu, Hyogo, both of Japan

[73] Assignee: Matsushita Electronics Corporation, Osaka, Japan

[21] Appl. No.: 778,146

[22] Filed: Mar. 16, 1977

[30] Foreign Application Priority Data

Mar. 19, 1976 Japan ..... 51-30659

[51] Int. Cl.[2] ..... H01J 61/16; H01J 61/30; H01J 61/44

[52] U.S. Cl. ..... 313/493; 313/220; 313/224; 313/226

[58] Field of Search ..... 313/493, 220, 224, 226

[56] References Cited

U.S. PATENT DOCUMENTS

| | | | |
|---|---|---|---|
| 2,501,375 | 3/1950 | Breadner et al. | 313/493 |
| 3,551,736 | 12/1970 | Doehner | 313/493 X |
| 3,609,436 | 9/1971 | Campbell | 313/493 X |
| 3,849,689 | 11/1974 | Campbell | 313/493 X |
| 3,903,447 | 9/1975 | Young et al. | 313/493 |

FOREIGN PATENT DOCUMENTS

| | | | |
|---|---|---|---|
| 906,245 | 3/1954 | Germany | 313/220 |

*Primary Examiner*—Palmer C. Demeo
*Attorney, Agent, or Firm*—Burgess, Ryan and Wayne

[57] ABSTRACT

A spherical or dome-shaped fluorescent lamp comprises a spherical or dome-shaped outer bulb and an inner bulb formed with a zig-zag groove over the outer surface thereof and inserted into the outer bulb to define a zig-zag discharge path therebetween. The discharge path has a substantially circular on elliptical cross sectional configuration and is filled with a discharge medium consisting of mercury and a rare gas or rare gas mixture for emitting ultraviolet radiation. A phosphor coating is applied to the inner wall surface of the outer bulb and/or the outer surface of the inner bulb.

1 Claim, 9 Drawing Figures

SPHERICAL-BULB FLUORESCENT LAMP

BACKGROUND OF THE INVENTION

The present invention relates to a spherical- or dome-shaped bulb fluorescent lamp.

In addition to incandescent lamps, fluorescent lamps have been widely used for interior lighting, but they are in general in the form of a tube, a ring and a flat panel so that even though their efficiency is considerably higher than that of the incandescent lamps they have a relatively large light emitting surface. That is, they are a low luminous light source so that they are not adapted for spot lighting or so-called accentuation lighting for emphasizing or exaggerating the contrast between the illuminated and dark areas of an object. On the other hand, the incandescent lamps are compact in size and have a high luminous efficiency so that they are best adapted for the so-called accentuation lighting, but their efficiency is about 15 lm/w which is considerably lower than the efficiency of 60 to 80 lm/w of the fluorescent lamps.

Because of the above disadvantages of the fluorescent lamps over the incandescent lamps as well as the energy saving problems there has been a growing demand for a fluorescent lamp which is compact in size yet retains its high lamp efficiency and may be used instead of the incandescent lamps. Demands only for high luminousity and efficiency are satisfied by the conventional high pressure vapour discharge lamps such as high-pressure mercury lamps, metal halide lamps or the like, but these lamps have a common and fatal disadvantage in that instant re-starting is impossible so that they cannot replace the incandescent lamps and the fluorescent lamps which may be re-started at a lower voltage.

SUMMARY OF THE INVENTION

One of the objects of the present invention is to provide a fluorescent lamp having a bulb shape substantially similar to that of the conventional incandescent lamps; that is, a fluorescent lamp in the form of a sphere or a dome.

Another object of the present invention is to provide a spherical or dome-shaped bulb fluorescent lamp which is compact in size yet has high efficiency and luminesity and a long service life.

A further object of the present invention is to provide a fluorescent lamp of the type described which is very simple in construction so that its mass production may be much facilitated.

To the above and other ends, the present invention provides a spherical or dome-shaped fluorescent lamp consisting of a spherical or dome-shaped outer glass bulb and an inner glass bulb inserted into the outer bulb to define a zig-zag discharge path between the inner wall surface of the outer bulb and the outer surface of the inner bulb, a discharge means consisting of electrodes and a discharge medium being placed in the zig-zag discharge path.

DESCRIPTION OF THE PREFERRED EMBODIMENT

Figure 1:
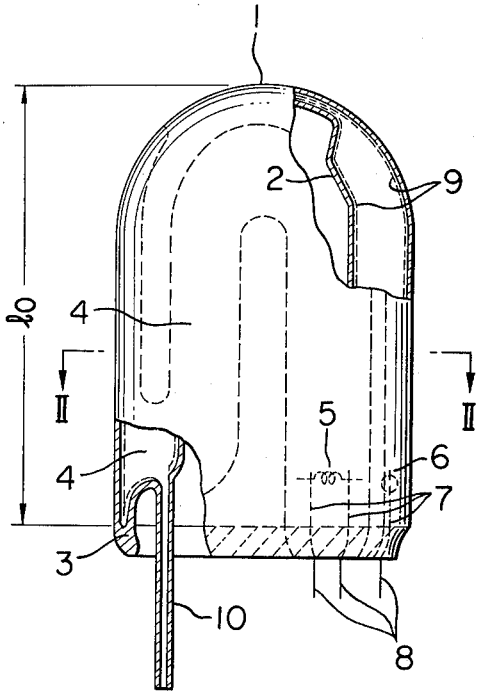
FIG. 1 is a side view partly broken away of one preferred embodiment of a fluorescent lamp in accordance with the present invention.

Referring to FIGS. 1 through 4, one preferred embodiment of a fluorescent lamp in accordance with the present invention consists of an outer bulb 1 and an inner glass bulb 2. The outer glass bulb 1 is in the form of a dome, and the inner glass bulb 2 is inserted into the outer bulb 1 to define a zig-zag discharge path or groove between the outer and inner bulbs 1 and 2. That is, the inner bulb 2 is formed at its outer surface with a continuous zig-zag groove and is inserted into the outer bulb 1 so that the zig-zag discharge path or groove 4 may be defined between the inner wall surface of the outer bulb 1 and the zig-zag groove of the inner bulb 2 when the open ends of the outer and inner bulbs 1 and 2 are joined or hermetically sealed at 3 with electrodes 5 and 6 placed at ends of the zig-zag discharge path or groove 4.

Figure 5:
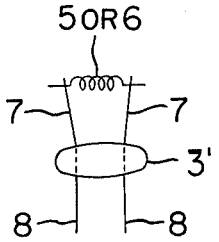
FIG. 5 is a schematic view of an electrode.

As shown in FIG. 5, the electrode 5 or 6 is substantially similar in construction to those used in conventional fluorescent lamps. It consists of a coiled tungsten filament supported by and electrically connected to filament supports or lead-in wires 7 which in turn are attached to a sealing member 3' made of the same material as the seal 3 and are electrically connected to lead wires 8. Filled between the turns of the coiled filament is an electron emission compound consisting of, for example, BaO, CaO and SrO.

Referring back to FIGS. 1 through 4, the inner wall surface of the outer bulb 1 and the outer wall surface of the inner bulb 2 are coated with a phosphor 9 which is excited by the 2537A radiation characteristic of the mercury atom to produce visible light. The phosphor coating 9 is disposed on the entire inner wall surface of the outer bulb 1 and/or the entire outer wall surface of the inner bulb 2. It is preferable to use the normal calcium halophosphate or the so-called rare earth-activated fluorescent materials. The latter are for instance europium-activated yttrium oxide ($Y_2O_3$:Eu) red fluorescent phosphor, terbium-activated cerium-magnesium aluminate ($CeMgAl_{11}O_{19}$:Tb) green fluorescent phosphor and europium-activated barium magnesium aluminate ($BaMgAl_{14}O_{24}$:Eu) blue fluorescent phosphor or europium-activated strontium-magnesium aluminate ($SrMg_2Al_{14}O_{24}$:Eu) blue fluorescent phosphor. When a reflecting layer such as a titanium oxide coating is previously coated over the outer surface of the inner bulb 2 and then the phosphor coating 9 is provided thereon, the lamp efficiency may be increased by 20 to 30%.

The air in the lamp is evacuated through an exhaust tube 10 with a very fine diameter, and then a discharge medium consisting of mercury and a rare gas is sealed therein. The quantity of mercury to be sealed is selected suitably within such a range that it may exceed a predetermined mercury vapour saturation level at a lowest temperature when the fluorescent lamp is turned on. The rare gas may be selected from a group consisting of He, Ne, Ar, Kr and Xe and may be a combination thereof. The most preferable sealing pressure is between 3 and 6 Torrs. Under a predetermined sealing pressure within the above range, it is most preferable to use He which exhibits the highest lamp efficiency, and the lamp efficiency is decreased progressively in the order of Ne, Ar, Kr and Xe. The fluorescent lamp in accordance with the present invention has a zig-zag discharge path or groove 4 so that as compared with the conventional straight tube type fluorescent lamps it has a higher re-ignition voltage Vr and consequently the arc extinction tends to occur very often. To solve this problem, it is preferable to use Ar only or a mixture gas consisting of Ne and Ar or Kr and Ar containing a relatively very small percentage of Ar. As compared with the sealing pressure of the order of a few Torrs used in the conventional straight-tube type fluorescent lamps, a higher sealing pressure is used in the present invention in order to prevent the arc extinction problem, but when the sealing pressure is less than 3 Torrs the arc extinction tends to occur when the lamp is turned on while when it exceeds 6 Torrs, the lamp efficiency decreases due to the increase in discharge current.

As with conventional straight-tube fluorescent lamps, the lamp efficiency is dependent upon the mercury vapour pressure in the lamp which in turn is dependent upon the lowest temperature in the lamp which is observed at the sealing point of the exhaust tube 10. The experiments conducted by the inventors showed that when the coolest temperature may be maintained between 43° and 50° C the maximum lamp efficiency can be attained.

Figure 2:
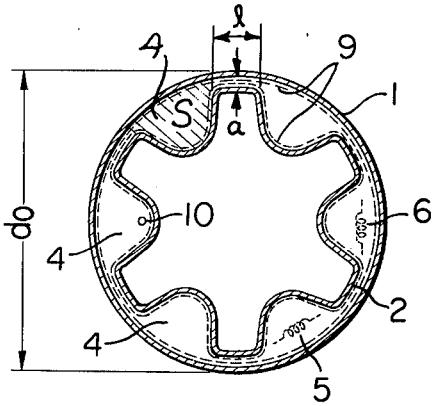
FIG. 2 is a sectional view taken along the line II—II' of FIG. 1.

Next the shapes and dimensions of the fluorescent lamps in accordance with the present invention will be described. First the outer dimensions are selected to be comparable with those of the conventional incandescent lamps, and accordingly the maximum diameter $d_0$ and height $l_0$ are 100 mm and 150 mm, respectively, as shown in FIGS. 1 and 2. The cross sectional dimensions $d_a$ and $d_b$ (See FIG. 4) of the discharge groove 4 as well as the effective discharge distance $l_d$ between the electrodes 5 and 6 are determined empirically based on the discharge characteristics to be described with reference to FIGS. 6 through 8. The maximum diameter of the inner bulb 2 is indicated by $d_1$.

Figure 6:
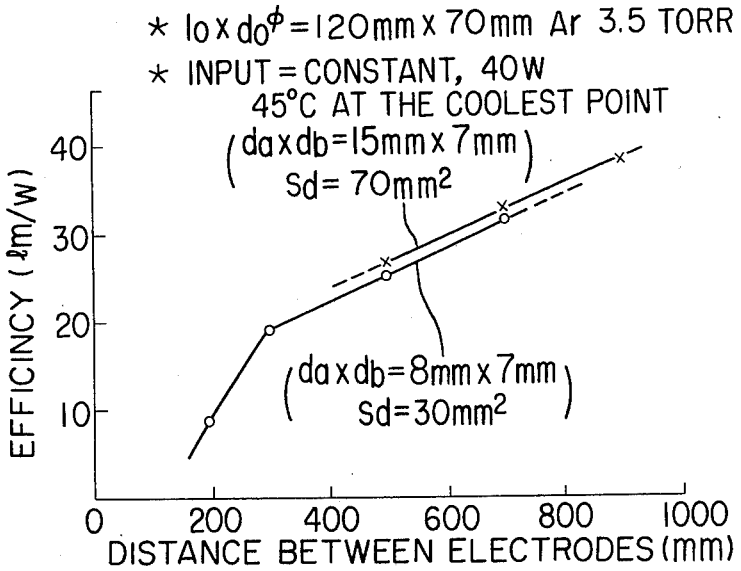
FIG. 6 shows the relationship between the efficiency (lm/w) and the distance $l_d$ (mm) between electrodes.
Figure 7:
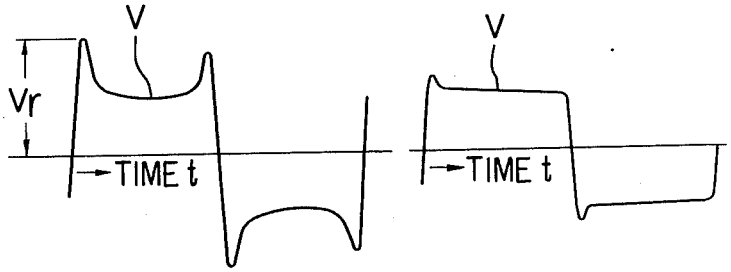
FIGS. 7(*a*) and 7(*b*) show tube voltage waveforms of the fluorescent lamp in accordance with the present invention and that of the prior art, respectively.

As shown in FIG. 6, it is preferable to select the electrode distance $l_d$ longer than 300 mm in order to ensure a lamp efficiency higher than 20 lm/w which is considerably higher than the average lamp efficiency of 15 lm/w of the conventional incandescent lamps. As see from FIG. 6, the dimensions $d_a$ and $d_b$ of the discharge groove 4 are important factors influencing the lamp efficiency, but the cross sectional area ($Sd \propto d_a \times d_b$) has a considerable effect on the tube voltage waveform when the lamp is turned on. That is, when the cross sectional area S*d* is decreased, the tube voltage waveform V is adversely distored as shown in FIG. 7(*a*). As compared with the tube voltage waveform shown in FIG. 7(*b*) of a conventional straight tube fluorescent lamp, the re-ignition voltage V*r* tends to increase, resulting in the frequent arc extinction. Furthermore the distorted tube voltage waveform causes the rapid consumption or emission of the electron emission compound.

Figure 8:
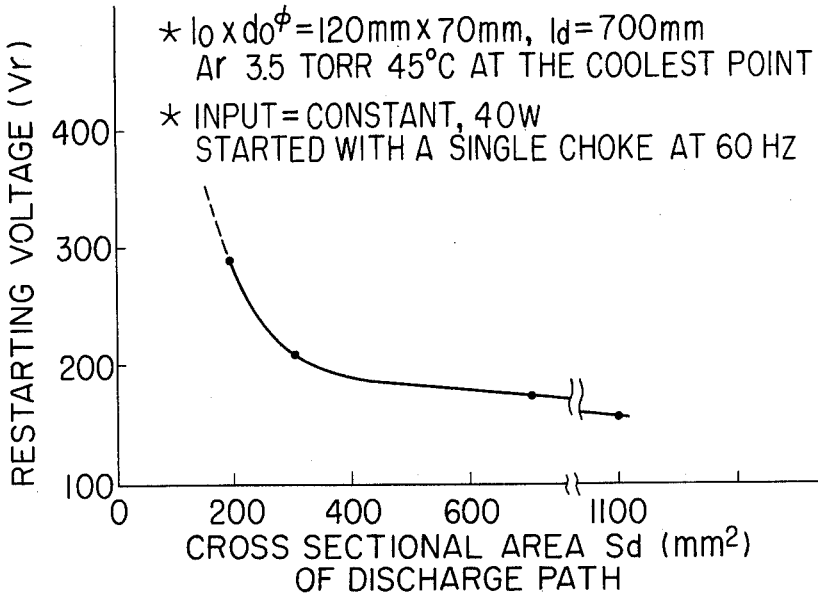
FIG. 8 shows the relationship between the re-starting voltage and the cross sectional area of the discharge path.

In FIG. 8 there is shown the dependence of the re-ignition voltage V*r* on the cross sectional area S*d* of the discharge path or groove 4. It is evident that the cross sectional area S*d* must be greater than 30 mm$^2$ so that the re-ignition voltage V*r* may be made lower and stable.

Figure 9:
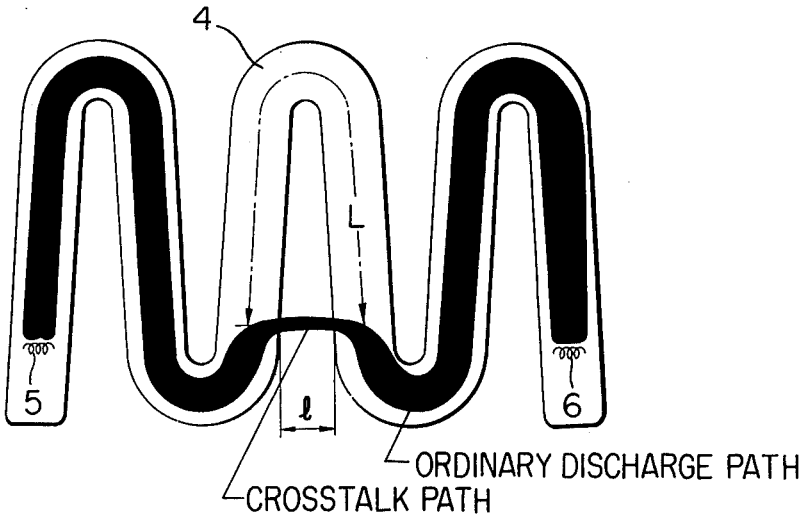
FIG. 9 is an unfolding view of a zig-zag discharge path.

From further experiments conducted by the inventors, it has been revealed that the lamps in accordance with the present invention have the problem of so-called cross talk between two adjacent discharge paths, as shown in FIG. 9. The cross talk tends to occur as the atomic weight of the filling rare gas increases.

Based on the experimental results, it has been concluded that, for preventing the cross talk, the ratio of the short path length *l*(mm) to the ordinary discharge path length L(mm) should be designed in the following ranges:

| Main element of filling gas | Range of the ratio (l/L) |
|---|---|
| Ne | $l/L \geqq 6/600$ |
| Ar | $l/L \geqq 10/600$ |
| Kr | $l/L \geqq 20/600$ |
| Mixture gas for example, (Na + Ar + Kr gas | $l/L \geqq (6x_{Ne} + 10x_{Ar} + 20x_{Kr})/600$ |

where $x_{Ne}$, and $x_{Ar}$ and $x_{Kr}$ are the mole fractions of Ne, Ar and Kr respectively in the mixture gas.

The specifications and characteristics of the fluorescent lamps in accordance with the present invention are shown in TABLE 1.

TABLE 1

| | SPECIFICATIONS | | | | | | CHARACTERISTICS* | | | | | |
|---|---|---|---|---|---|---|---|---|---|---|---|---|
| | Dimensions | | | | Rare gas | Fluorescent | Input | Efficiency | Lumen | Vr | Tω | M |
| Lamps | $L_0 \times d_0$ | $d_a \times d_b$ | Sd | ld | (Torr) | materials | (W) | (lm/W) | (lm) | (V) | (° C) | (%) |
| | mm | mm | mm | mm | | | | | | | | |
| A | 120 × 70 | 15 × 7 | 70 | 700 | 3.5 | $<Y_2O_3$:Eu + $CeMgAl_{11}O_{18}$: Bu + $SrMg_2Al_{14}O_{24}$:Bu | 40 | 33 | 1320 | 175 | 90 | 87 |
| B | " | " | " | " | " | ($Y_2O_3$:Bu + $CeMgAl_{11}O_{18}$: Bu + $SrMg_3Al_{14}O_{14}$:Bu) | 40 | 32 | 1200 | 175 | 90 | 80 |
| C | " | " | " | " | " | $3Ca(PO_4)_6$ $Ca(F,Cl)_2$:Sb,Mn | 48 | 26 | 1040 | 175 | 92 | 55 |
| D | " | " | " | " | " | Same with the lamp A except that a $TiO_4$ coating is applied to the outer surface of the inner bulb | 40 | 40 | 1600 | 175 | 95 | 87 |
| E | 150 × 100 | 20 × 8 | 110 | 900 | " | Same with the lamp A | 40 | 38 | 1620 | 150 | 85 | 89 |
| F | " | " | " | " | " | " | 80 | 35 | 1800 | 155 | 90 | 86 |
| G | 180 × 20 | 25 × 10 | 180 | 900 | " | " | 100 | 34 | 3400 | 140 | 90 | 87 |
| H | 120 × 70 | 15 × 7 | 70 | 700 | Ar70%+ Ne30% 5 Torr | " | 40 | 35 | 1400 | 190 | 90 | 94 |

TABLE 1-continued

| | SPECIFICATIONS | | | | | | CHARACTERISTICS* | | | | | |
|---|---|---|---|---|---|---|---|---|---|---|---|---|
| | Dimensions | | | | Rare gas | Fluorescent | Input | Effi-ciency | Lumen | Vr | Tω | M |
| Lamps | $L_0 \times d_0$ | $d_a \times d_b$ | Sd | ld | (Torr) | materials | (W) | (lm/W) | (lm) | (V) | (° C) | (%) |
| I | 120 × 70 | 15 × 7 | 70 | 700 | (Ar50% +Kr50%) 3.5 | " | 40 | 33 | 1320 | 150 | 80 | 89 |

*T = temperature at the outside wall at a position substantially corresponding to the midpoint of the discharge path;
M = ratio in % of a luminousity after 1,000 hours of again to an initial luminousity;

Efficiency as well as V*r* were measured with the temperature at the coolest point being 45° C when the lamps were started with a single choke at 60 Hz.

The lamp C was coated with calcium halophosphate ($3Ca_3(PO_4)$ Ca[F, Cl] : Sb, Mn) and has a low lamp efficiency. The reason is that since the lamp is of the dome shape and is made compact in size, the wall temperature rises so that the emission efficiency of the phosphor coating drops. Because of this reason, it is preferable to use the rare-earth-activated fluorescent materials which are stable in operation even at elevated temperatures.

Figure 3:
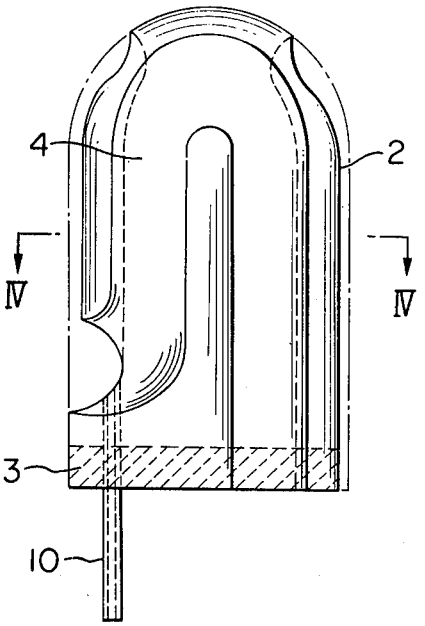
FIG. 3 is a side view of an inner bulb thereof.
Figure 4:
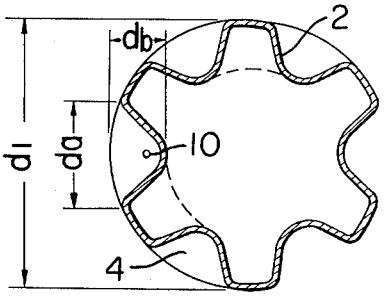
FIG. 4 is a cross sectional view taken along the line IV—IV' of FIG. 3.

Next the process for manufacture of fluorescent lamps in accordance with the present invention will be described. First the dome-shaped outer bulb 1 as shown in FIGS. 1 and 2 and the inner bulb as shown in FIGS. 3 and 4 are prepared. The groove 4 of the inner bulb 2 are formed by press at temperature higher than the vitrification point of the glass. After the phosphor coating is applied to the inner wall surface of the outer bulb 1 and the outer surface of the inner bulb 2, the latter is inserted into the former and then the open ends of the outer and inner bulbs 1 and 2 are sealed together. The electrodes shown in FIG. 5 are placed immediately before the outer and inner bulbs 1 and 2 are sealed and their sealing members 3' are sealed together with the bulbs 1 and 2. Thereafter the air in the bulbs or discharge path or groove 4 is evacuated and the electrodes are activated with the electron emission compound. A predetermined quantity of the mercury and rare gas mixture is filled and the discharge pipe 10 is sealed or tipped off.

In summary, the spherical or dome-shaped fluorescent lamps in accordance with the present invention may be made very compact in size and have a high lamp efficiency as well as a long service life of 5,000 to 7,000 hours which is equivalent to that of the conventional fluorescent lamps. Furthermore, the fluorescent lamps in accordance with the present invention may be used instead of the conventional incandescent lamps for commercial and residential lighting and especially for lighting of a limited area.

What is claimed is:

1. A fluorescent lamp comprising:

an outer bulb having a generally spherical or dome-shaped configuration;

an inner bulb disposed within said outer bulb, said bulbs being configured to define a zig-zag discharge path comprising a series of adjacent legs between the inner wall surface of the outer bulb and the outer wall surface of the inner bulb, the portions of said bulbs adjacent said path being spaced apart a distance in the range of 0.1 to 0.5 millimeter from each other to permit communication between adjacent legs of said path in a direction substantially perpendicular to said legs, the distance between said adjacent legs measured along said path being L, and the distance between adjacent legs measured in a direction substantially perpendicular to said legs being *l*;

an electrode at each end of said discharge path;

a radiation-emitting discharge gas comprising Neon, Argon or Krypton disposed in the space between said bulbs; and a phosphor coating on a wall surface of one of said bulbs adjacent said discharge gas, wherein the ratio of *l* to L is (i) at least 6:600 when said gas comprises Neon, (ii) at least 10:600 when said gas comprises Argon, (iii) at least 20:600 when said gas comprises Krypton, and (iv) at least $(6x_{Ne} + 10x_{Ar} + 20x_{Kr})$:600 when said gas comprises a mixture of Neon, Argon and Krypton, where $x_{Ne}$, $x_{Ar}$ and $x_{Kr}$ are the volumetric mole fractions of Neon, Argon and Krypton respectively.

* * * * *

UNITED STATES PATENT OFFICE

CERTIFICATE OF CORRECTION

Patent No. 4,095,135 Dated June 13,1978

Inventor(s) Haruo Yamazaki, et al

It is certified that error appears in the above-identified patent and that said Letters Patent are hereby corrected as shown below:

Column 1, line 47: "luminesity" should be --luminosity--.

Column 4, line 5: "see" should be --seen--.

line 46: "mole" should be --mol--.

In Table 1, in the second column: "$L_0$" should be --$l_0$--.

In Table 1, Lamp "G": "180 X 20" should be --150 X 120--.

In Table 1, the penultimate entry under "Rare gas": "Ar70%" should be --Ar50%--.

In Table 1, in the entries under "Fluorescent materials": all occurrences of "Bu" should be --Eu--.

In Table 1, under the column "Fluorescent materials": "$CeMgAl_{11}O_{18}$" should be --$CeMgAl_{11}O_{19}$--.

In Table 1, under the column "Fluorescent materials": "$SrMg_3Al_{14}O_{14}$" should be --$SrMg_2Al_{14}O_{24}$--.

In Table 1, under the column "Fluorescent materials": "$TiO_4$" should be --$TiO_2$--.

In Table 1, in the column headed "Input": The entry "48" and "80" should be --40-- and --60--, respectively.

UNITED STATES PATENT OFFICE

CERTIFICATE OF CORRECTION

Patent No. 4,095,135 Dated June 13, 1978

Inventor(s) Haruo Yamazaki, et al

It is certified that error appears in the above-identified patent and that said Letters Patent are hereby corrected as shown below:

In Table 1, in the column headed "Lumen": "1200" and "1620" should be --1280-- and --1520--, respectively.

In Table 1, in the column headed "Vr": "150" should be --160--.

In Table 1, in the column headed "M": "94" should be --84--.

In Table 1, column 5 of patent: "$L_0$\ " should be --$l_0$ X--.

In Table 1, column 6 of patent, in column headed "Tω": "80" should be --90--.

Column 6, line 46: "mole" should be --mol--.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*